United States Patent [19]

Castle

[11] 4,277,913

[45] Jul. 14, 1981

[54] CURTAIN ROD FOR SLIDING GLASS DOOR

[76] Inventor: Ross M. Castle, 100 Castle, Florissant, Mo. 63034

[21] Appl. No.: 77,004

[22] Filed: Sep. 19, 1979

[51] Int. Cl.[3] ..... E06B 7/00

[52] U.S. Cl. ..... 49/70; 49/54; 49/65; 160/90

[58] Field of Search ..... 49/70, 50, 54, 65; 160/89-92; 211/105.3

[56] References Cited

U.S. PATENT DOCUMENTS

| | | | |
|---|---|---|---|
| 386,423 | 7/1888 | Cornell . | |
| 1,062,478 | 5/1913 | Kroder . | |
| 1,128,420 | 2/1915 | Decker . | |
| 1,405,416 | 2/1922 | Howell et al. | 160/92 |
| 1,509,098 | 9/1924 | Callender | 160/92 |
| 1,785,838 | 12/1930 | McClure | 49/70 X |

*Primary Examiner*—Philip C. Kannan

*Attorney, Agent, or Firm*—Senniger, Powers, Leavitt and Roedel

[57] ABSTRACT

A curtain rod for a sliding glass door in a wall comprising a first rod section and brackets mounting the first rod section on the door in position extending generally horizontally across a face of the door, the first rod section being spaced laterally from the face for supporting a plurality of hooks or the like adapted to support a curtain. The curtain rod further comprises a second rod section and a bracket mounting the second rod section independently of the door in axial alignment with the first rod section. The first and second rod sections have a sliding fit with respect to each other and constitute an extensible rod assembly, the rod assembly being extended as the door is closed and contracted as the door is opened. The rod assembly is adapted to support a curtain extending across the face of the door in both closed and open positions of the door.

14 Claims, 3 Drawing Figures

CURTAIN ROD FOR SLIDING GLASS DOOR

BACKGROUND OF THE INVENTION

This invention relates to curtain rods, and more particularly to a curtain rod for a sliding glass door in a wall.

Although certain rods for swinging doors have long been available, such rods are not practical for use on sliding glass doors because of interference with the operation of the door assembly. Thus, either the curtain rod or a portion thereof secured to a movable door panel would abut against a fixed door panel or wall, or vice-versa, thereby blocking the movement of the movable door panel to its fully opened position.

Because of the impracticality of hanging curtains thereon, the use of sliding doors has involved an esthetic penalty. Independent of esthetics, the use of sliding glass doors has presented a safety hazard, with numerous injuries incurred by children and adults who ran, fall, or thrust a limb through a glass panel of such a door.

SUMMARY OF THE INVENTION

Among the several objects of this invention may be noted the provision of a curtain rod adapted to support a curtain extending across the entire face of a sliding glass door assembly without interfering with the operation of the door assembly, the provision of such a curtain rod which acts as a safety barrier for reducing the likelihood of people colliding with the door assembly and breaking the glass door panels; and the provision of such a curtain rod which may be locked so as to prevent the unintended opening of the door assembly.

Briefly, the curtain rod of this invention is for use on a sliding glass door in a wall. It comprises a first rod section and means for mounting the first rod section on the door in position extending generally horizontally across a face of the door, the first rod section being spaced laterally from said face for supporting a plurality of hooks or the like adapted to support a curtain. The curtain rod further comprises a second rod section and means for mounting the second rod section independently of the door in axial alignment with the first rod section. The rod sections have a sliding fit with respect to each other and constitute an extensible rod assembly, the rod assembly being extended as the door is closed and contracted as the door is opened. The rod assembly is adapted to support a curtain extending across the face of the door in both closed and open positions of the door.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
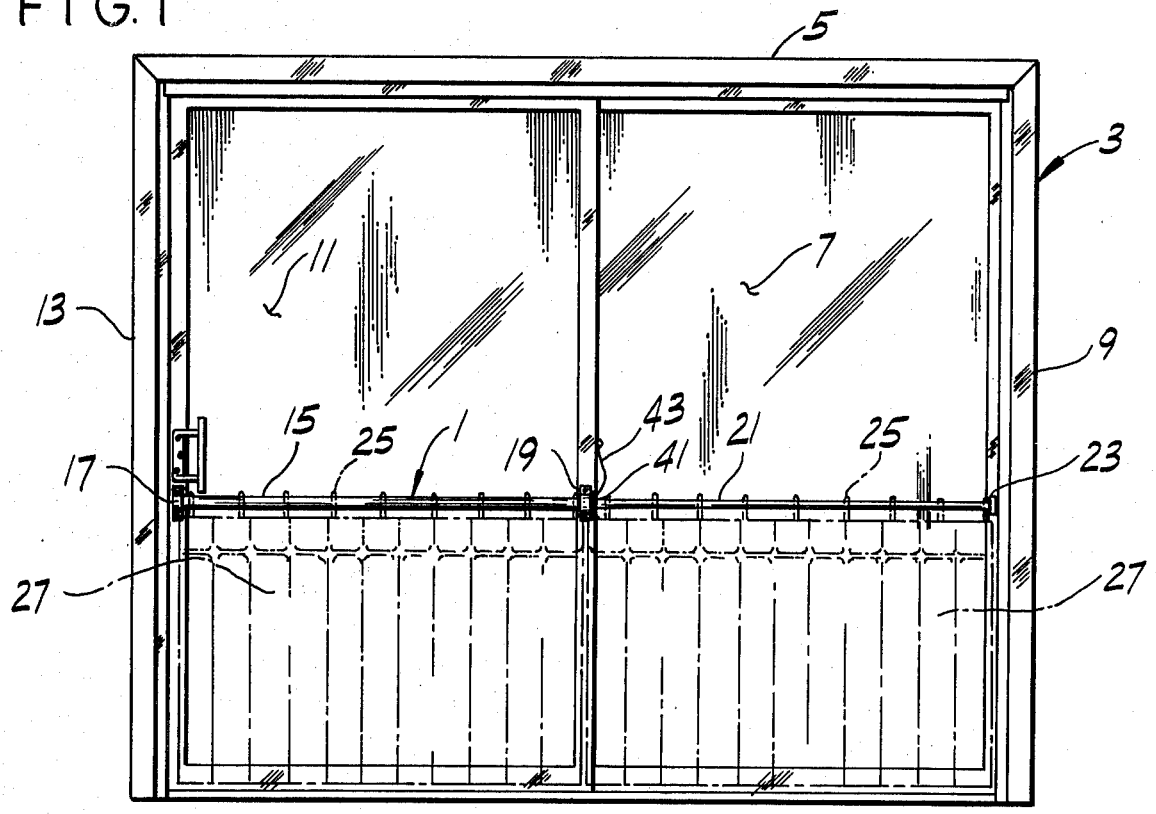
FIG. 1 is an elevation of a curtain rod of this invention attached to a glass door in a wall showing the door in its closed position.

Referring to the drawings, there is generally indicated at 1 a curtain rod of this invention for a glass door assembly 3 in a wall comprising a frame 5 for securement to the wall, a first or fixed glass door panel 7 secured to the frame at a first end 9 of the frame and a second or movable glass door panel 11 slideable in the frame toward and away from a closed position at a second end 13 of the frame.

The curtain rod comprises a first rod section 15 and means such as first and second brackets 17 and 19, respectively, for mounting the first rod section on the movable door panel in position extending generally horizontally across a face of the movable door panel. The curtain rod further comprises a second rod section 21 and means such as third bracket 23 for securing the second rod section to the frame in axial alignment with the first member. The first rod section 15 is spaced laterally from the face of the movable door panel 11 and the second rod section 21 is spaced laterally from a face of the fixed door panel 7 for supporting a plurality of hooks or the like 25 adapted to support a curtain generally indicated at 27. The rod sections have a sliding fit with respect to each other and constitute an extensible rod assembly, the rod assembly extending as the movable door panel is moved toward its closed position shown in FIG. 1 and retracting as the movable door panel is moved away from its closed position to an open position shown in FIG. 2. The assembly of the first and second rod sections is adapted to support a curtain extending across the faces of the first and second door panels in both closed and open positions of the movable door panel.

In particular, the first rod section 15 comprises a length of circular cross section tube approximately as long as the movable door panel is wide. It is releasably secured at one end thereof to the first bracket 17 by fastening means such as screw threads on the first rod section and on an interior circular surface of the bracket defining a circular recess therein. The first rod section at its other end is received within a circular opening in the second bracket 19. The brackets are secured to opposite ends of the movable door panel by conventional fastening means such as screws 29. A resilient stop such as a cylinder of rubber 31 or a compression spring (not shown) may be disposed within the first rod section, this stop is engageable at one end thereof with the first bracket and at its other end with the second rod section for limiting the travel of the second rod section relative to the first rod section upon moving the movable door panel to a fully opened position as more fully described hereinafter. A bushing 33 of a material having a low coefficient of friction is releasably secured within the first rod section at its other end for guiding the second rod section and spacing the exterior surface thereof from the interior surface of the first rod section to reduce the friction on the rod sections upon closing the movable door section.

The second rod section 21 is a length of circular cross section tubing having an outside diameter less than the inside diameter of the bushing 33 so that it may be received within the first rod section through the bushing in sliding engagement. One end of the second rod is closed by a plug 35 engageable with the stop 31 and the other end is releasably secured to the third bracket 23 by fastening means such as screw threads on the second rod section and on an interior circular surface of the third bracket defining a circular recess therein. The third bracket is mounted on the frame by conventional means such as screws 29. The second rod section is slightly longer than the fixed door panel is wide so that it will extend within the first rod section with the movable door panel in closed position.

As described above, the first and second rod sections constitute an extensible rod assembly, the rod assembly extending as the movable door panel is moved toward its closed position and retracting as the movable door panel is moved away from its closed position. An important feature of this invention is the provision of lock means 37 for securing the rod assembly in an extended position when the locking means is in its locking mode to prevent the unintended movement of the door assembly to the fully open position. The lock means comprises a series of holes 39 at discrete intervals along an end portion of the second rod section, and a pin 41 adapted to be received in any one of the holes and to project outwardly beyond the outer surface of the second rod section to be engageable with the bushing 33 at the end of the first rod section for preventing movement of the movable door panel past the pin. When the movable door panel is in the fully closed position, hole 39A is adjacent the bushing 33 and the other holes are spaced at varying distances outside the bushing. By insertion of pin 41 in hole 39A, the movable door panel is locked in the fully closed position. With the pin 41 received in any one of the other holes, the movable door panel is secured in partially open position for enabling passage of air through the door assembly for ventilation yet blocking unintended entry through the door assembly. Preferably the pin 41 is a hitch or hair pin clip having means for releasably securing the pin to the second rod section. To hold the pin captive to the door assembly when the locking means is not in its locking mode, means for tethering the pin such as a length of line 43 is provided, the line being secured at one end thereof to the movable door panel.

Figure 2:
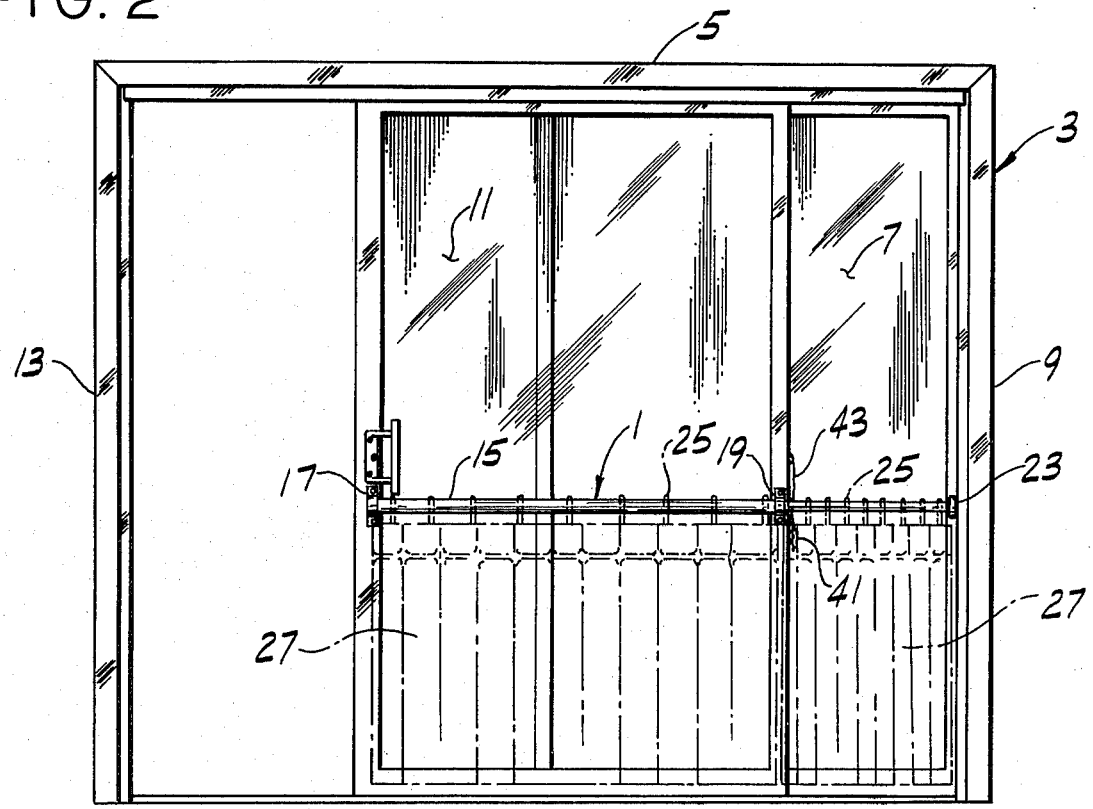
FIG. 2 is a view similar to FIG. 1 but showing the door in open position.
Figure 3:
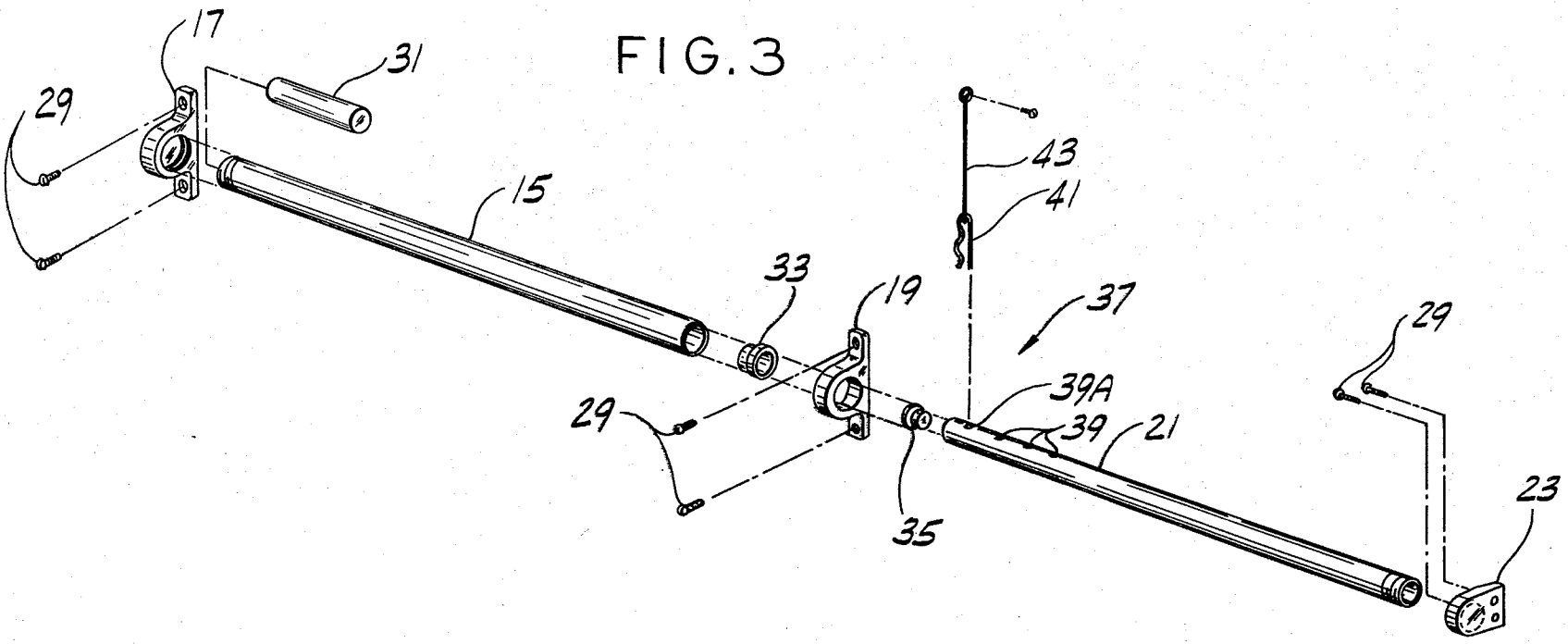
FIG. 3 is an enlarged, exploded view of the curtain rod.

As shown in FIG. 2, with the movable door panel in its closed position the curtain rod 1 of this invention supports the hooks 25 at spaced intervals therealong and supports the curtain 27 across the faces of both the movable and fixed door panels. The height of the curtain may be adjusted by varying the mounting location of the brackets 17, 19 and 23 on the door panels and frame. The curtain may thus cover all or just portions of the faces of the door panels to give the desired decorative effect and degree of privacy. The curtain rod, when extended and with its locking means in its locking mode, prevents entry through the door from the face or side of the door assembly opposite that upon which the curtain rod is mounted. In addition, the curtain rod, whether the rod assembly is extended or contracted, acts as a safety barrier to reduce the likelihood of people colliding with and breaking the glass door panels of the door assembly.

As the movable door panel 11 is moved to open position, the rod assembly contracts with the second rod section sliding under the hooks 25 supported thereon, and the portion of the curtain 27 extending across the face of the fixed door panel 7 gathers together in a rucked condition. The movable door panel 11 may be opened by moving the door panel away from the end 13 of the frame 5 until the door panel reaches its fully opened position at which point the second rod section 21 is in engagement with the resilient stop 31.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A curtain rod for a sliding glass door in a wall, said curtain rod comprising:

a first rod section;

means for mounting the first rod section on the door in position extending generally horizontally across a face of the door, said rod section being spaced laterally from said face for supporting a plurality of hooks or the like, said mounting means comprising first and second brackets adapted to be secured to the door at opposite ends thereof;

a second rod section; and a third bracket for mounting the second rod section independently of the door in axial alignment with the first rod section;

said rod sections having a sliding fit with respect to each other and constituting an extensible assembly, said assembly being extended as the door is closed and contracted as the door is opened, said assembly being adapted to support a curtain extending across the face of the door in both closed and open positions of the door.

2. A curtain rod as set forth in claim 1 wherein said first rod section comprises a tube, said second rod section being telescoped within the first rod section.

3. A curtain rod as set forth in claim 1 wherein said assembly has a stop for limiting the travel of the second rod section relative to the first rod section upon moving the door to a fully opened position.

4. A curtain rod as set forth in claim 1 further comprising locking means for preventing contraction of the assembly and thus opening of the door when the locking means is in its locked mode.

5. A curtain rod as set forth in claim 4 wherein said locking means comprises a hole extending transversely through one of the rod sections at an end portion thereof and a pin adapted to be received in said hole and to project outwardly beyond said one of the rod sections so as to be engageable with the other rod section to prevent contraction of the assembly.

6. A curtain rod as set forth in claim 5 wherein said locking means comprises a series of holes at discrete locations spaced longitudinally of said one of the rod sections and extending therethrough, said pin being adapted to be received in any of said holes.

7. A curtain rod as set forth in claim 5 wherein said pin has means for releasably securing it to said one of the rod sections.

8. A curtain rod as set forth in claim 5 wherein said pin has means for holding it tethered to the door.

9. A curtain rod as set forth in claim 8 wherein said means for holding the pin tethered comprises a length of line secured at one end thereof to the door.

10. A curtain rod as set forth in claim 1 wherein said first bracket has means for releasably securing the first rod section thereto.

11. A curtain rod as set forth in claim 8 wherein said second bracket has an opening therethrough adapted to receive the first rod section.

12. A curtain rod as set forth in claim 1 wherein said third bracket has means for releasably securing the second rod section thereto.

13. In combination, a glass door assembly in a wall comprising a frame for securement to the wall, a first glass door panel secured to the frame at a first end of the frame and a second glass door panel slideable in the frame toward and away from a closed position at a second end of the frame, and a curtain rod for the glass door assembly, said curtain rod comprising:

a first rod section;

means for mounting the first rod section on the movable door panel in position extending generally horizontally across a face of the movable door panel;

a second rod section; and means for securing the second rod section to the frame in axial alignment with the first rod section;

said first rod section being spaced laterally from said face of the movable door panel and said second rod section being spaced laterally from a face of the secured door panel for supporting a plurality of hooks or the like, adapted to support a curtain, said rod sections having a sliding fit with respect to each other and constituting an extensible rod assembly, said rod assembly extending as the movable door panel is moved toward its closed position and retracting as the movable door panel is moved away from its closed position, said rod assembly being adapted to support a curtain extending across the faces of the secured and movable door panels in both closed and open positions of the movable door panel.

14. In combination, a sliding glass door in a wall and a curtain rod for the sliding glass door, said curtain rod comprising:

a first rod section;

means for mounting the first rod section on the door in position extending generally horizontally across a face of the door, said rod section being spaced laterally from said face for supporting a plurality of hooks or the like;

a second rod section; and means for mounting the second rod section independently of the door in axial alignment with the first rod section;

said rod sections having a sliding fit with respect to each other and constituting an extensible assembly, said assembly being extended as the door is closed and contracted as the door is opened, said assembly being adapted to support a curtain extending across the face of the door in both closed and open positions of the door.

* * * * *

UNITED STATES PATENT AND TRADEMARK OFFICE

CERTIFICATE OF CORRECTION

PATENT NO. : 4,277,913

DATED : July 14, 1981

INVENTOR(S) : Ross M. Castle

It is certified that error appears in the above—identified patent and that said Letters Patent is hereby corrected as shown below:

Column 4, claim 11, line 66, "claim 8" should read --claim 10--.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*